US010364652B2

(12) United States Patent
Lopez et al.

(10) Patent No.: US 10,364,652 B2
(45) Date of Patent: Jul. 30, 2019

(54) MISALIGNMENT IN COUPLING SHUNT TUBES OF WELL SCREEN ASSEMBLIES

(71) Applicant: Halliburton Energy Services, Inc., Houston, TX (US)

(72) Inventors: Jean-Marc Lopez, Plano, TX (US); John C. Gano, Houston, TX (US)

(73) Assignee: Halluburton Energy Services, Inc., Houston, TX (US)

( * ) Notice: Subject to any disclaimer, the term of this patent is extended or adjusted under 35 U.S.C. 154(b) by 640 days.

(21) Appl. No.: 14/762,890

(22) PCT Filed: Mar. 1, 2013

(86) PCT No.: PCT/US2013/028722
§ 371 (c)(1),
(2) Date: Jul. 23, 2015

(87) PCT Pub. No.: WO2014/133553
PCT Pub. Date: Sep. 4, 2014

(65) Prior Publication Data
US 2015/0361765 A1 Dec. 17, 2015

(51) Int. Cl.

| | |
|---|---|
| ***E21B 43/08*** | (2006.01) |
| ***E21B 41/00*** | (2006.01) |
| ***E21B 43/04*** | (2006.01) |
| ***E21B 17/05*** | (2006.01) |

(52) U.S. Cl.
CPC ..... *E21B 41/00* (2013.01); *E21B 17/05* (2013.01); *E21B 43/04* (2013.01); *E21B 43/08* (2013.01)

(58) Field of Classification Search
CPC ..... E21B 43/04; E21B 43/08
See application file for complete search history.

(56) References Cited

U.S. PATENT DOCUMENTS

| | | | | |
|---|---|---|---|---|
| 5,314,032 | A | 5/1994 | Pringle et al. | |
| 5,868,200 | A * | 2/1999 | Bryant | E21B 43/04 166/242.3 |
| 5,996,712 | A | 12/1999 | Boyd | |
| 6,409,219 | B1 | 6/2002 | Broome et al. | |
| 6,474,701 | B1 | 11/2002 | Bowles et al. | |
| 7,165,635 | B2 * | 1/2007 | Kauffman | E21B 17/05 166/344 |
| 7,497,267 | B2 * | 3/2009 | Setterberg, Jr. | E21B 17/02 166/227 |
| 8,413,724 | B2 * | 4/2013 | Carbaugh | E21B 17/085 166/344 |
| 9,797,226 | B2 * | 10/2017 | Yeh | E21B 17/18 |

(Continued)

OTHER PUBLICATIONS

PCT International Preliminary Report on Patentability, PCT/US2013/028722, dated Sep. 11, 2015, 13 pages.

(Continued)

*Primary Examiner* — Brad Harcourt
*Assistant Examiner* — Steven A MacDonald
(74) *Attorney, Agent, or Firm* — Scott Richardson; Parker Justiss, P.C.

(57) ABSTRACT

A system for coupling a shunt tube of a first screen assembly to a shunt tube of a second screen assembly includes an elongate jumper tube and a misalignment joint. The misalignment joint has a first end coupled to the jumper tube. The first end is moveable relative to a second end of the misalignment joint.

11 Claims, 4 Drawing Sheets

(56) References Cited

U.S. PATENT DOCUMENTS

| | | | | |
|---|---|---|---|---|
| 2005/0211444 | A1* | 9/2005 | Kauffman | E21B 17/05 166/380 |
| 2006/0283604 | A1* | 12/2006 | Setterberg, Jr. | E21B 17/02 166/380 |
| 2008/0128129 | A1* | 6/2008 | Yeh | E21B 17/02 166/275 |
| 2009/0008092 | A1* | 1/2009 | Haeberle | E21B 33/12 166/278 |
| 2010/0032158 | A1* | 2/2010 | Dale | E21B 43/04 166/278 |
| 2010/0300699 | A1* | 12/2010 | Papon | E21B 17/01 166/367 |

OTHER PUBLICATIONS

PCT International Search Report and Written Opinion of the International Searching Authority, PCT/US2013/028722, dated Nov. 27, 2013, 16 pages.

Halliburton, "Removable Fracturing Liner", copyright 2011, 2 pages.

Halliburton, "Sand Control Screen and Inflow Control Technology Solutions", copyright 2012, 2 pages.

Baker Hughes, "Equalizer Flow Control Technologies, Maximize Economic Value by Equalizing Flow", copyright 2013, 6 pages.

* cited by examiner

MISALIGNMENT IN COUPLING SHUNT TUBES OF WELL SCREEN ASSEMBLIES

CROSS-REFERENCE TO RELATED APPLICATIONS

This application is a 371 U.S. National Phase application of and claims the benefit of priority to International Application No. PCT/US2013/028722, filed on Mar. 1, 2013, the contents of which are hereby incorporated by reference.

BACKGROUND

Wells often use screen systems in their production string to filter solid particles (e.g., sand) greater than a permitted size. Some wells are gravel packed by placing gravel in the annulus around the well screen system. For example, in an open-hole completion, gravel is typically placed between the wall of the wellbore and the production string. Alternatively, in a cased-hole completion, gravel is placed between a perforated casing string and the production string. In both types of completions, formation fluids flow from the subterranean formation into the production string through the gravel pack and well screen system.

The gravel is carried into the well with a carrier liquid in a slurry. Premature loss of the carrier liquid into the formation can result in an incomplete packing of the production interval and cause sand bridges to form in the annulus. Alternate flow paths through the well screen systems can be used to provide an alternate path around the sand bridges. For example, shunt tubes in the well screen assemblies and jumper tubes between the well screen assemblies can be used to bypass sand bridges.

DESCRIPTION OF DRAWINGS

Like reference symbols in the various drawings indicate like elements.

DETAILED DESCRIPTION

In some implementations, in completing an open hole section of a well, a production string having one or more well screen assemblies is run into the open hole section of the well bore. The screen assemblies are axially spaced along the length of the string. Each screen assembly has a filtration screen that encircles a base pipe. The base pipe has portion with one or more apertures that allow communication of fluids through the screen, and a portion not apertured (i.e., fluid impermeable) outside of the screen. An apertured shroud is positioned around the exterior of the filtration screen. Shunt tubes run axially through the screen assembly from one end to the other, and are radially between the apertured shroud and base pipe. The ends of the filtration screen are capped with annular end rings. The screen assemblies thread end to end, and jumper tubes connect between the end rings to connect the shunt tubes of one screen assembly to the next. Another shroud, not apertured (fluid impermeable), is positioned around the jumper tubes between the screen assemblies. With the production string in place, the annulus around the well screen assemblies is "gravel packed." In gravel packing, a particulate (e.g., gravel) laden slurry is pumped into the wellbore exterior the string. The particulate is deposited in the annulus around the screen assemblies, and the liquid in the slurry is pumped backed to the surface.

While the threads of the screen assembly joints are typically clocked so that the shunt tubes of one screen assembly are azimuthally aligned with the shunt tubes of the adjacent screen assembly, the clocking is imperfect and allows some azimuthal misalignment of the shunt tubes. Thus, the jumper tubes need to accommodate the azimuthal misalignment. The shunt and jumper tubes are often non-circular cross-sections, and the azimuthal misalignment of the shunt tubes manifests in an additional, rotational misalignment of the jumper tube profile to its mating profile associated with the shunt tube. Therefore, a misalignment joint can be provided to compensate one or both of the azimuthal and rotational misalignments.

Figure 1:
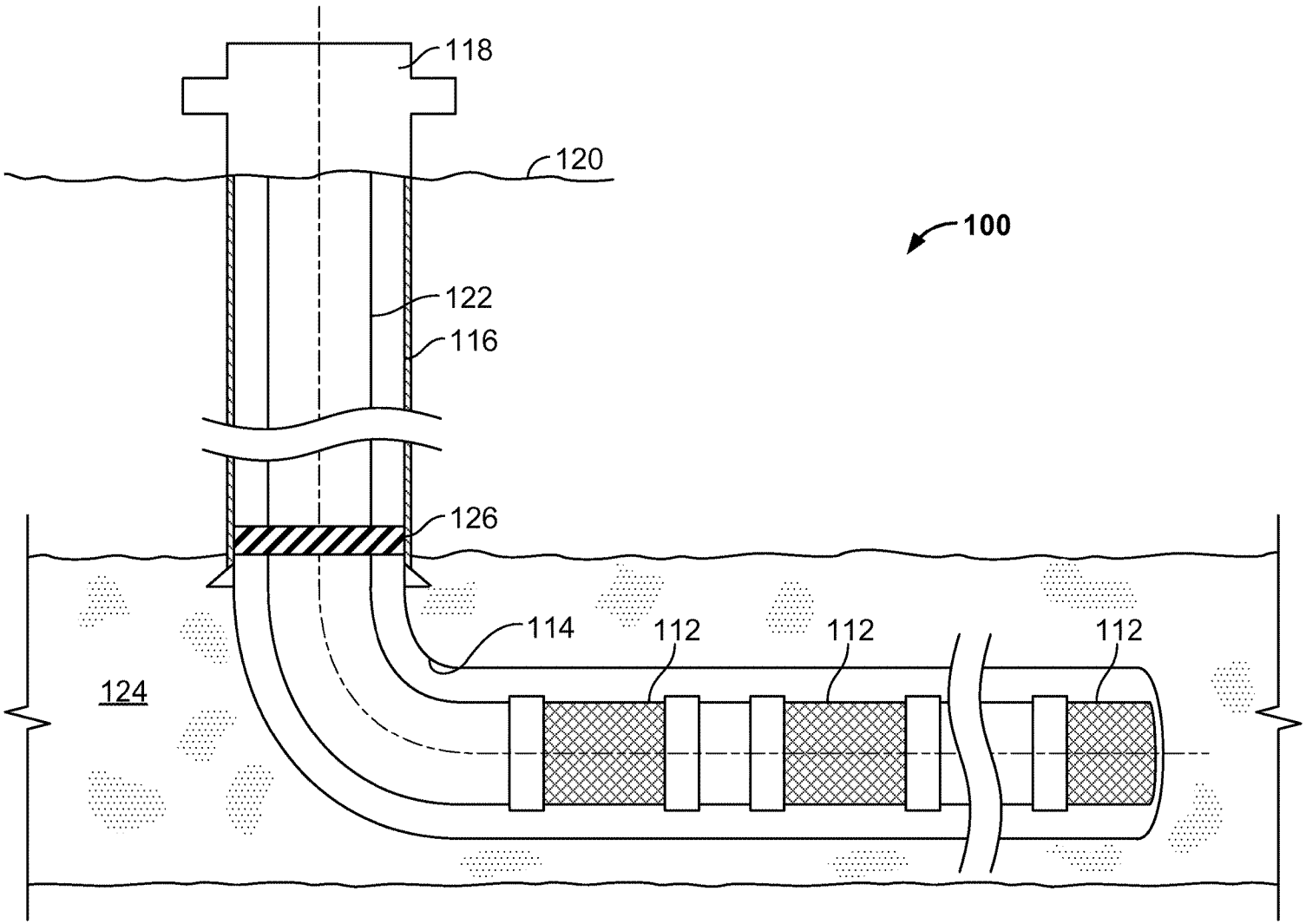
FIG. 1 is a schematic side view of a well system in accordance with the present disclosure.

FIG. 1 is a schematic side view of a well system 100 in accordance with the present disclosure. The well system 100 is shown as being a horizontal well, having a wellbore 114 that extends substantially vertically from a wellhead 18 at the surface, then deviates to horizontal or substantially horizontal in the subterranean zone of interest 124. A casing 116 is cemented in the vertical portion of the wellbore and coupled to the wellhead 118 at the surface 120. The remainder of the wellbore 114 is completed open hole (i.e., without casing). A production string 122 extends from wellhead 118, through the wellbore 114 and into the subterranean zone of interest 124.

A production packer 126 seals the annulus between the production string 122 and the casing 116. Additional packers 126 can be provided between the screen assemblies 112. The production string 122 operates in producing fluids (e.g., oil, gas, and/or other fluids) from the subterranean zone 124 to the surface 120. The production string 122 includes one or more well screen assemblies 112 (three shown). In some instances, the annulus between the production string 122 and the open hole portion of the wellbore 114 may be packed with gravel and/or sand. The well screen assemblies 112 and gravel/sand packing allow communication of fluids between the production string 122 and subterranean zone 124. The gravel/sand packing provides a first stage of filtration against passage of particulate and larger fragments of the formation to the production string 122. The well screen assemblies 112 provide a second stage of filtration, and are configured to filter against passage of particulate of a specified size and larger into the production string 122.

Although shown in the context of a horizontal well system 100, the concepts herein can be applied to other well configurations, including vertical well systems consisting of a vertical or substantial vertical wellbore, multi-lateral well systems having multiple wellbores deviating from a common wellbore and/or other well systems. Also, although described in a production context, concepts herein can are applicable in other contexts, including injection (e.g., with the well screen assembly 112 as part of an injection string), well treatment (e.g., with the well screen assembly 112 as part of a treatment string) and/or other applications.

Figure 2:
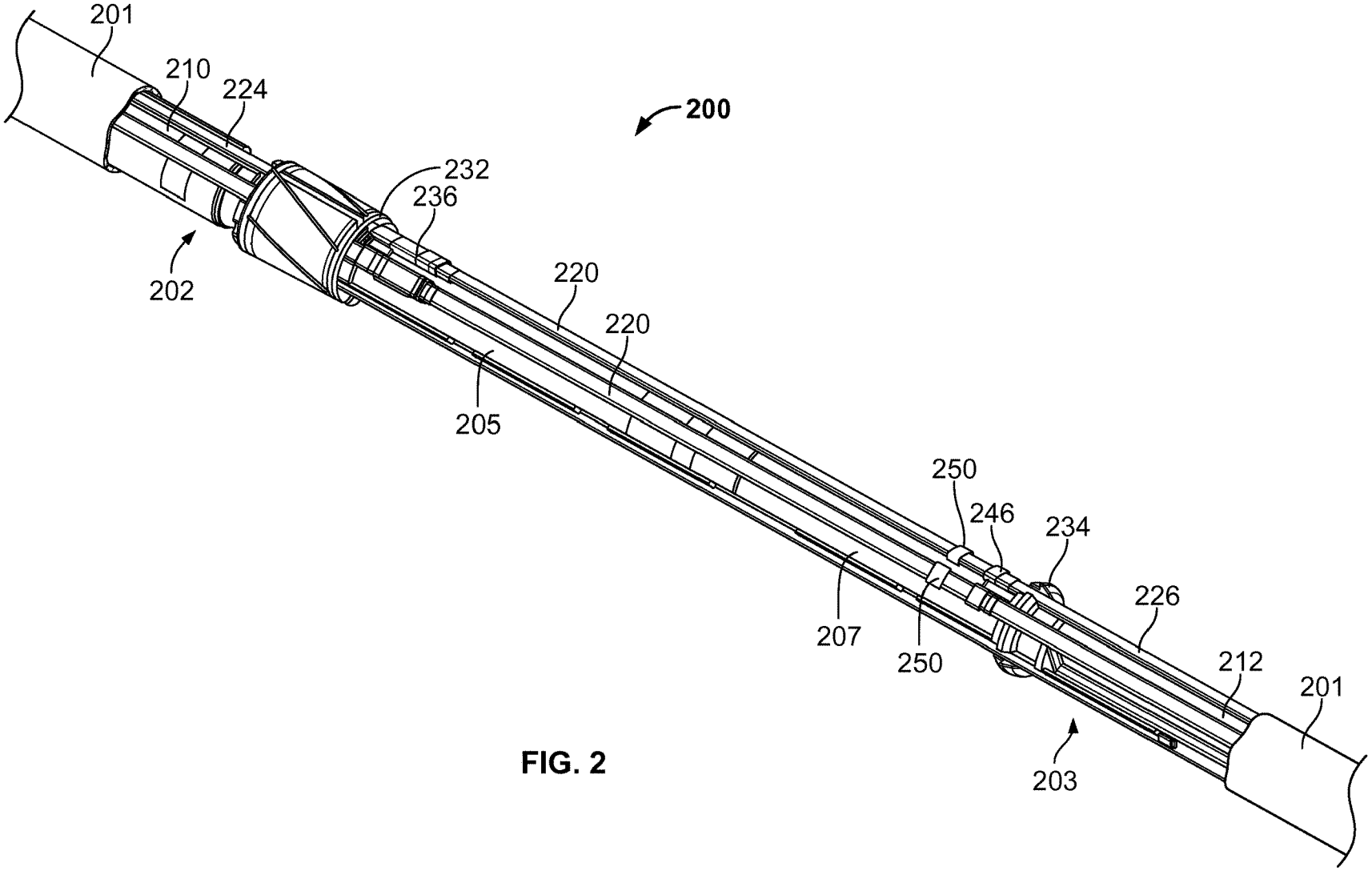
FIG. 2 is a perspective view of an example of a well screen system applicable to the well system of FIG. 1.

FIG. 2 illustrates an example manner of connecting two well screen assemblies of an example well screen system 200 that can be used in the well system of FIG. 1. For convenience of description, the well screen system 200 is illustrated with its inner components exposed (i.e., the outer shroud 201 is shown in partial break away). The well screen system 200 includes a first well screen assembly 202 and a second well screen assembly 203. The well screen assembly 202 includes a base pipe 205; and the well screen assembly 203 includes a base pipe 207. The base pipes 205 and 207 are coupled end to end to each other (e.g., threadingly and/or otherwise). The well screen assembly 202 further includes a screen 210 around the base pipe 205. For example, the screen 210 can include one or more layers of sheet mesh or wire wrapped screen with a selected industry rating for filtering solid materials over a specified size. Similarly, the screen assembly 203 further includes a screen 212 around the base pipe 207, the screen 212 being similar to the screen 210.

An elongate shunt tube 224 is arranged axially along the base pipe 205 and terminated at an end ring 232 of the base pipe 205. The shunt tube 224 extends to another end ring (not shown) at the opposite end of the base pipe 205. The shunt tube 224 enables fluid to bypass during gravel packing operations. Similarly, the well screen assembly 203 includes an elongate shunt tube 226 that is arranged axially along the base pipe 207 and terminated at an end ring 234. The shunt tube 226 may be substantially similar to the shunt tube 224.

As illustrated in FIG. 2, each well screen assembly 202 or 203 includes one or more shunt tubes (two per well screen assembly are shown). The shunt tubes can be radially positioned between the screen 210 and the outer shroud 201. In some implementations, the shunt tube 224 may be geometrically constrained to fit between the screen and the shroud, such that the cross section of the shunt tube 224 is not circular. In certain instances, the cross-section resembles a flat rounded rectangle that is wider than tall. The shunt tubes 224 and 226 are fluidically coupled by an elongate jumper tube 220 received between the shut tubes 224, 226. The jumper tube 220 can have a substantially similar cross section to the shunt tubes 224 and 226 (also shown resembling a flat rounded rectangle). The shunt tubes 224 or 226 and the jumper tube 220 can be connected using coupling sleeves 236, 246. The jumper tubes 220 and the shut tubes 224, 226 can include an outer profile for carrying seals to form a liquid and/or gas tight seal with the coupling sleeve 236, 246.

One or more a misalignment joints 250 can be provided to compensate for any misalignment of the jumper tubes 220 to shunt tubes 224, 226. The misalignment joints 250 can be affixed to one or both ends of the jumper tube 220, affixed intermediate the ends of the jumper tube 220 (i.e., with a portion of the jumper tube 220 on each side of the misalignment joint 250), affixed to ends of one or both of the shunt tubes 224, 226 and/or otherwise provided. The misalignment joint 250 has a first end that is movable relative to a second end, thus allowing the first end and/or a portion of the jumper tube 220 on one side of the misalignment joint 250 to misalign relative to the remainder of the jumper tube 220 and misalignment joint 250. In certain instances, the misalignment joint 250 is configured to allow the first end of the misalignment joint 250 to misalign relative to the remainder of the misalignment joint 250, so that the central longitudinal axis of one portion of the misalignment joint 250 is at an acute angle relative to the central longitudinal axis of the other portion of misalignment joint 250. In certain instances, the misalignment joint 250 is configured to allow the first end of the misalignment joint 250 to rotate on its center longitudinal axis relative to the remainder of the misalignment joint 250. In certain instances, the misalignment joint 250 can accommodate both forms of misalignment. The misalignment joints 250 enable the jumper tube 220 to connect the shunt tube 224 to the shunt tube 226 when the shunt tubes 224 and 226 are azimuthally) misaligned. In certain instances, the misalignment joints 250 can also include a telescoping portion to make up any axial gap between the jumper tube 220 and shunt tube 224, 226.

For example, if the first and second well screen assemblies are not precisely clocked, the shunt tubes 224 and 226 are azimuthally misaligned, with the center longitudinal axis of the shunt tube 224 being not collinear with the center longitudinal axis of the shunt tube 226. Additionally, if the shunt tubes 224, 226 and jumper tube 220 are not circular in cross section, the non-circular shape of the shunt tube 224 is rotated on a longitudinal axis relative to the shunt tube 226. With one end of the jumper tube 220 rigidly affixed to one of the shunt tubes 224, in certain instances, the misalignment joint 250 compensates for the misalignment by allowing the jumper tube 220 to span the azimuthal misalignment of the center longitudinal axis of the shunt tubes 224, 226. Additionally or alternatively, in certain instances, the misalignment joint can compensate for the misalignment by allowing the other end of the jumper tube 220 to rotate to align its non-circular shape with the non-circular shape of the shunt tubes 226.

Figure 3:
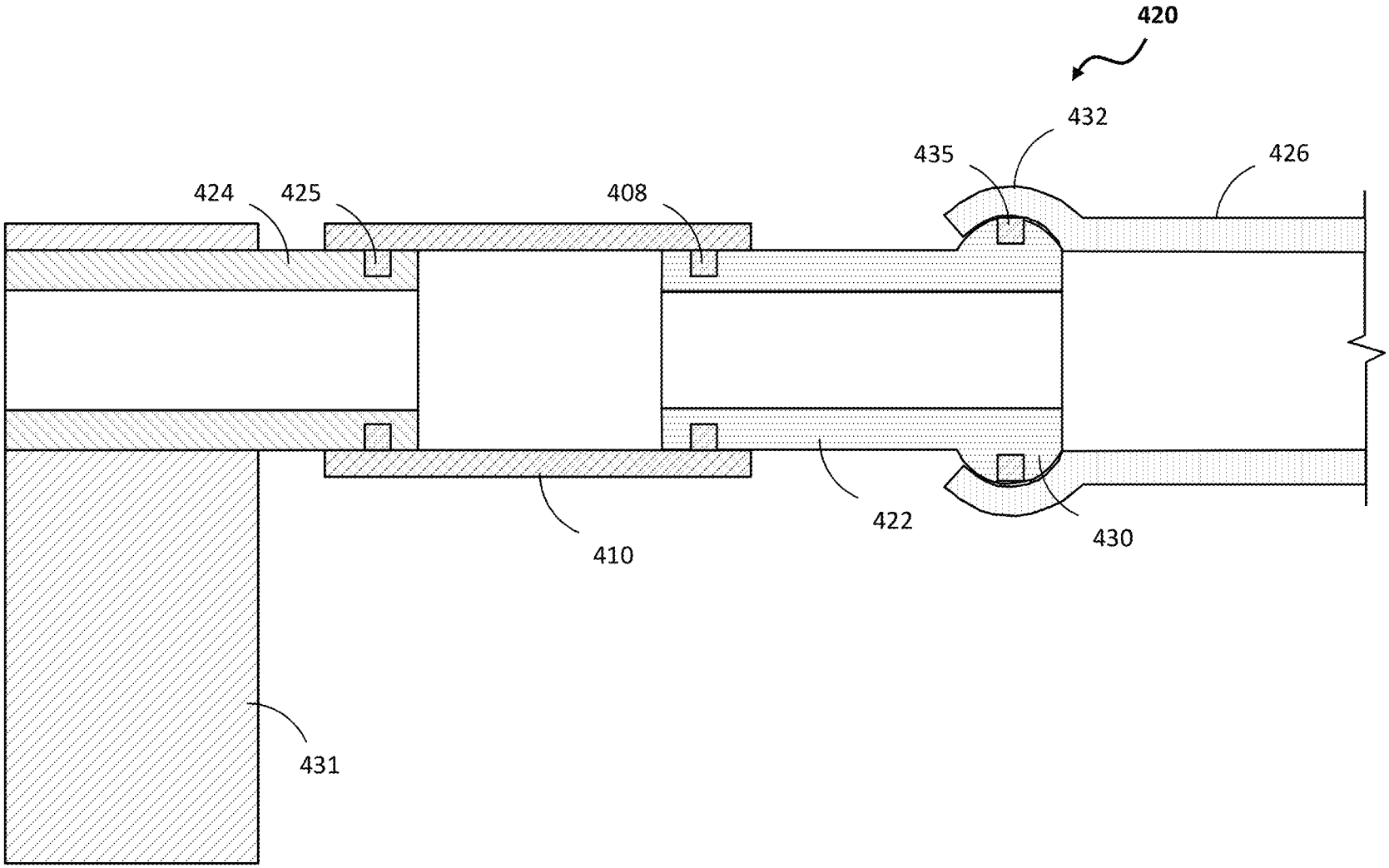
FIGS. 3 and 4 are schematic side cross-sectional side views of an example misalignment joint.
Figure 4:
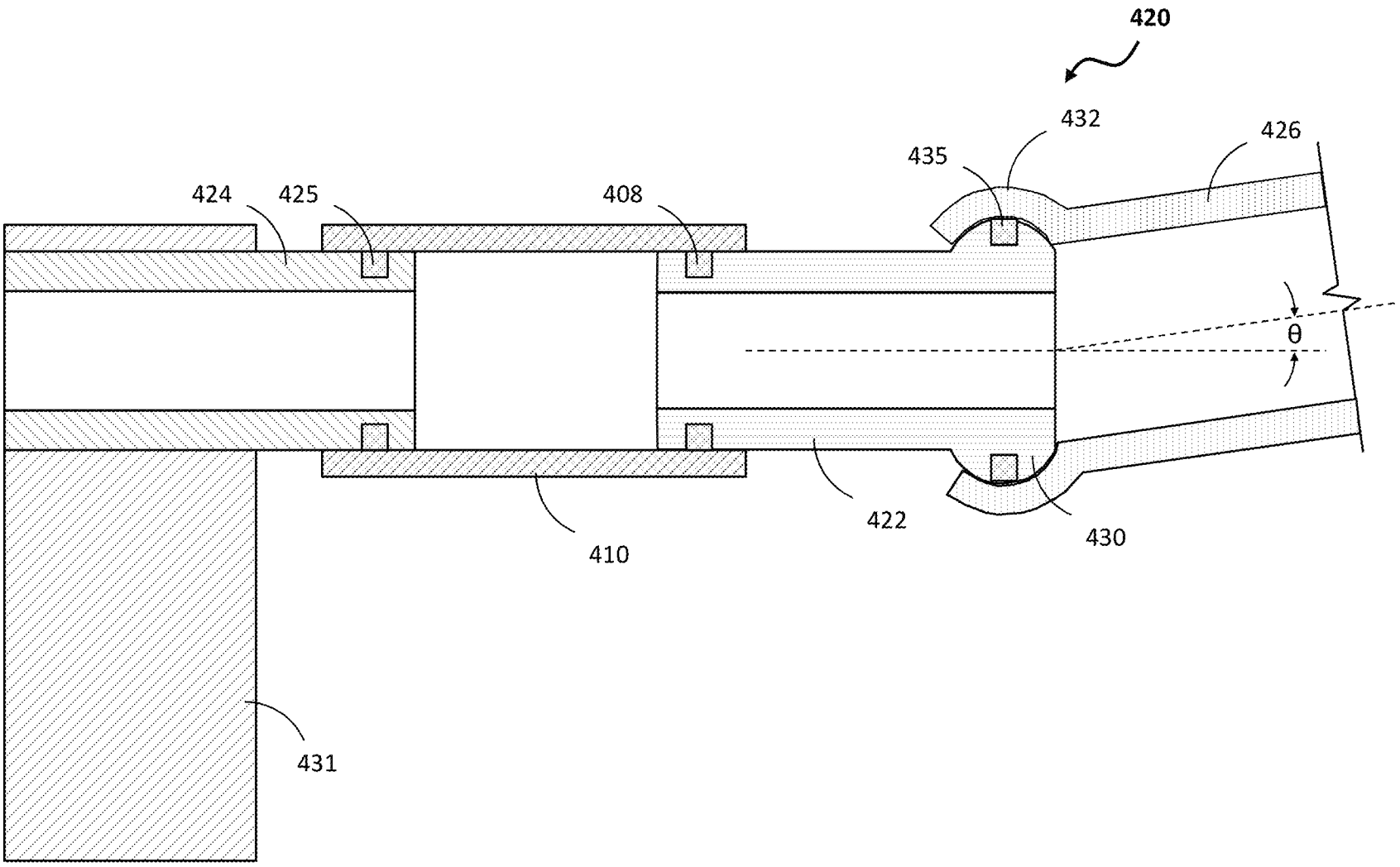

While the misalignment joint can take many forms, FIG. 3 is a cross-sectional side view of an example misalignment joint 420, particularly a knuckle joint, that can be used in the well screen system 200 of FIG. 2. FIG. 3 shows an end ring 431 of a well screen assembly with a shunt tube 424 extending therefrom. The misalignment joint 420 is shown affixed to an end of a jumper tube 426. The misalignment joint 420 includes a semi-spherical male portion 430 received in a mating female portion 432. The semi-spherical male portion 430 and the semi-spherical female portion 432 are sealed by a seal 435 that circumscribes the male portion 430. The male and female portions 430, 432 are configured to allow an end of the misalignment joint 420 to misalign relative to the remainder of the misalignment joint 420, so that the central longitudinal axis of one portion of the misalignment joint 420 is at an acute angle (θ) relative to the central longitudinal axis of the other portion of misalignment joint 420, as shown in FIG. 4. The male and female portions 430, 432 are further configured to allow an end of the misalignment joint 420 to rotate on its center longitudinal axis relative to the remainder of the misalignment joint 420.

Notably, although the misalignment joint 420 is described as being a knuckle joint with a semi-spherical male portion rotably received in a female portion, other configurations of misalignment joints could be used.

FIG. 3 additionally shows an axially telescoping joint 410. The joint 410 includes an outer sleeve that slides over one or both of the shunt tube 424 or tube 422 associated with the end of the misalignment joint 420. Seals 425, 408 can be provided to seal the telescoping joint 410 with the shunt tube 424 or tube 422. The axially telescoping joint 410 makes up any axial gap between the jumper tube 426 and the shunt tube 424.

A number of examples have been described. Nevertheless, it will be understood that various modifications may be made. Accordingly, other examples are within the scope of the following claims.

What is claimed is:

1. A well screen system, comprising:

a first well screen assembly comprising a first base pipe, a first screen around the first base pipe and a first shunt tube arranged axially along the first base pipe;

a second well screen assembly comprising a second base pipe coupled to the first base pipe, a second screen around the second base pipe and a second shunt tube arranged axially along the second base pipe;

a jumper tube having a non-circular cross-section between and fluidically coupling the first and second shunt tubes; and a tubular misalignment joint having a first end azimuthally or rotationally movable relative to a second end to compensate for misalignment of the first shunt tube and the jumper tube.

2. The well screen system of claim 1, where the misalignment joint comprises a knuckle joint comprising a semi-spherical male portion associated with the first end and rotably received in a female portion associated with the second end.

3. The well screen system of claim 2, where the misalignment joint comprises a seal sealing between the male portion and female portion.

4. The well screen system of claim 1, where the first end of the misalignment joint is rotatable on a longitudinal axis of the misalignment joint relative to the second end.

5. The well screen system of claim 4, where the first and second ends of the misalignment joint are movable to form an acute angle between a longitudinal axis of a first portion comprising the first end and a second portion comprising the second end.

6. The well screen system of claim 1, where the first and second ends of the misalignment joint are movable to form an acute angle between a longitudinal axis of a first portion comprising the first end and a second portion comprising the second end.

7. The well screen of claim 1, comprising an axially telescoping joint.

8. The well screen system of claim 1, where the misalignment joint is intermediate two portions of the jumper tube.

9. The well screen system of claim 1, where the first shunt tube is azimuthally misaligned with the second shunt tube, and the misalignment joint spans the jumper tube to the first shunt tube, compensating for the misalignment.

10. The well screen system of claim 9, where the first shunt tube comprises a non-circular cross-section.

11. The well screen system of claim 1, where the jumper tube is rigidly affixed to the second shunt tube.

* * * * *